US006176205B1

(12) United States Patent
Smith

(10) Patent No.: US 6,176,205 B1
(45) Date of Patent: Jan. 23, 2001

(54) PRESSURIZATION OF THE ENGINE COOLING SYSTEM

(75) Inventor: Gary M. Smith, Waterford, MI (US)

(73) Assignee: DaimlerChrysler Corporation, Auburn Hills, MI (US)

( * ) Notice: Under 35 U.S.C. 154(b), the term of this patent shall be extended for 0 days.

(21) Appl. No.: 09/283,455

(22) Filed: Apr. 1, 1999

(51) Int. Cl.[7] ..... F01P 11/20

(52) U.S. Cl. ..... 123/41.5; 123/41.27; 123/41.52; 123/41.53

(58) Field of Search ..... 123/41.5, 41.14, 123/41.27, 41.52, 41.53

(56) References Cited

U.S. PATENT DOCUMENTS

| | | | | |
|---|---|---|---|---|
| 2,841,127 | * | 7/1958 | Baster | 123/41.27 |
| 2,878,794 | * | 3/1959 | Stromberg | 123/41.27 |
| 3,238,932 | * | 3/1966 | Simpson | 123/41.5 |
| 3,775,947 | | 12/1973 | Dupont et al. . | |
| 4,130,159 | | 12/1978 | Ohta et al. . | |
| 4,231,424 | | 11/1980 | Moranne . | |
| 4,346,757 | * | 8/1982 | Cheong et al. | 123/41.27 |
| 4,457,362 | | 7/1984 | Cadars . | |
| 4,463,802 | | 8/1984 | Villeval . | |
| 4,723,596 | | 2/1988 | Spindelboeck et al. . | |
| 4,739,730 | | 4/1988 | Jenz et al. . | |
| 5,111,776 | | 5/1992 | Matsushiro et al. . | |
| 5,329,889 | | 7/1994 | Caldwell . | |
| 5,456,218 | | 10/1995 | Theorell . | |
| 5,511,590 | | 4/1996 | Turcotte et al. . | |
| 5,649,574 | | 7/1997 | Turcotte et al. . | |
| 5,673,733 | | 10/1997 | Turcotte et al. . | |
| 5,680,833 | | 10/1997 | Smith . | |
| 5,839,398 | | 11/1998 | Hamilton . | |

FOREIGN PATENT DOCUMENTS

| | | | | |
|---|---|---|---|---|
| 247723 | * | 11/1969 | (RU) | 123/41.5 |

* cited by examiner

*Primary Examiner*—Willis R. Wolfe
*Assistant Examiner*—Katrina B. Harris

(57) ABSTRACT

The present invention provides an airtight reservoir in fluid communication with a cooling system of an internal combustion engine. This cooling system allows coolant to flow into the overflow bottle, thereby compressing air therein, and causing increases pressure. When the coolant again cools, the pressurized coolant flows back into the cooling system, thereby maintaining the system pressure above ambient.

4 Claims, 2 Drawing Sheets

PRESSURIZATION OF THE ENGINE COOLING SYSTEM

BACKGROUND OF THE INVENTION

Field of the Invention

I. Technical Field

The present invention relates to an engine cooling system, and more particularly to an engine cooling system having an overflow bottle which maintains the cooling system in a pressurized state.

II. Discussion

Engine cooling systems play a critical role in internal combustion engine performance and operation. Primarily, the engine cooling system is responsible for maintaining the engine below a specific temperature by pumping heat, generated by the combustion of fuel within the engine, out to a radiator and ultimately to the atmosphere.

Typical automobile engine cooling systems are known as closed cooling systems. Closed cooling systems circulate a cooling medium, such as an antifreeze-water mixture, through a fully encapsulating circulatory system. This system has the advantage of using the increased temperature within the cooling system to correspondingly increase the pressure. Increased pressure increases the boiling point of the coolant which, as is understood by one skilled in the art, thereby increases the effectiveness of the system in dissipating heat. However, if the temperature of the engine and corresponding cooling medium becomes too high, the pressure within the cooling system will exceed design characteristics and cause damage to the system unless the system is fitted with some means for relieving this pressure. To reduce this pressure buildup, typical cooling systems are fitted with a pressure relieving cap and a reservoir. This cap, typically on the radiator, has a valve which allows pressurized coolant to flow into the tank when the pressure exceeds a specified limit. These check valves typically allow the pressure within the system to build to 14–18 psi before allowing coolant to flow into the tank.

When the engine and corresponding cooling system cools, the pressure within the system drops while the excess coolant remains in the reservoir. When the pressure of the system drops below atmospheric pressure, the difference in pressure between the system and the atmosphere causes coolant within the reservoir to flow back into the cooling system until the pressure equalizes. As a result, anytime the engine and corresponding cooling system is decreasing in temperature, the pressure of the system is usually at or below atmospheric pressure. Low pressure corresponds to a low boiling point temperature which, as discussed above, results in the system having a reduced effectiveness in dissipating heat.

To overcome this drawback, pressurized reservoirs which are maintained at the same pressure as the cooling system and through which a portion of the engine coolant circulates have been developed. These tanks allow the coolant space to expand and contract while maintaining the cooling system at a higher than atmospheric pressure. However, these reservoirs have several drawbacks. First, because of their complexity, typical pressurized reservoirs are rather large, thereby requiring much room in the engine compartment of an automobile. With the ever increasing number of components within an engine compartment, it is difficult to find room for such a tank. Second, again because of their complexity, these reservoirs are expensive. This, too, is an undesirable feature. Third, these reservoirs require at least two additional plumbing circuits to supply coolant to and remove from the reservoir.

SUMMARY OF THE INVENTION

The present invention overcomes the aforementioned drawbacks, among others, by providing an airtight reservoir with an air space in fluid communication with a cooling system of an internal combustion engine. This cooling system allows coolant to flow into the reservoir, thereby compressing air and increasing pressure. When the coolant again cools, the pressurized coolant flows back into the cooling system, thereby maintaining the system pressure above ambient.

In another aspect of the present invention, the reservoir contains a membrane ensuring that coolant and air do not mix. Also, a meltable plug can be fitted within a passage, which allows fluid communication between the reservoir and the cooling system, to allow filling of the system while maintaining the reservoir in a dry condition.

Additional advantages and features of the present invention will be apparent from the subsequent description and the appended claims taken in conjunction with the accompanying drawings.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
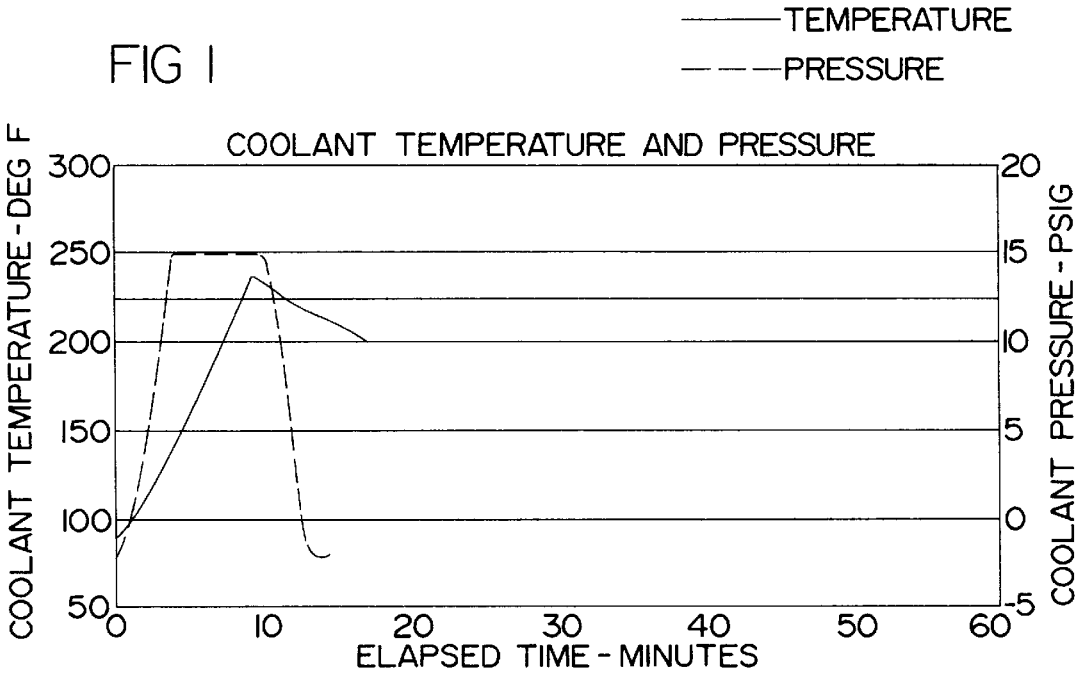
FIG. 1 is a graphical depiction of the state of the engine coolant during operation of a vehicle using a reservoir according to the prior art.
Figure 1:
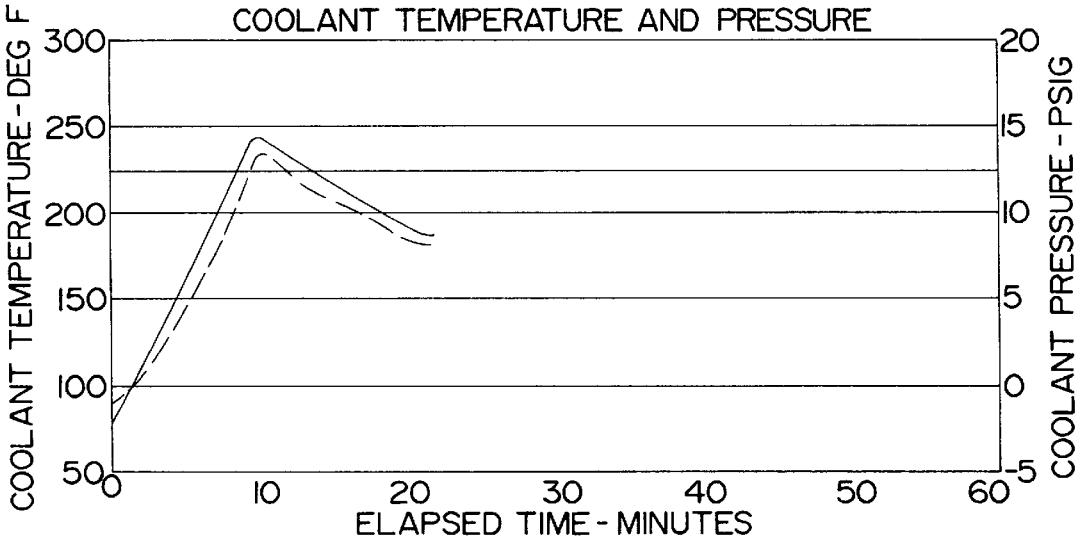

Referring now to FIG. 1, the operation of a conventional cooling system according to the prior art is graphically depicted. Between time=0 minutes and time=10 minutes, a vehicle containing an internal combustion engine is undergoing a heavy load, such as that associated with traveling up the side of a mountain. During this time, the engine generates heat at a rate greater than the cooling system can expel. As a result, the temperature and pressure within the cooling system increases. Once the pressure reaches the cooling system cap relief pressure, a relief valve is opened and coolant flows into a reservoir at ambient pressure. Between 10 and 20 minutes, the vehicle undergoes a light load, such as that associated with traveling down the side of a mountain. In this situation, the cooling system expels more heat than the engine generates. As a result, the temperature and corresponding pressure, as shown, decreases. Because the coolant in the reservoir is at ambient pressure, it does not flow back into the cooling system until the system is at a pressure below ambient. The absence of the excess coolant in the system, combined with a drop in pressure, causes the pressure within the system to rapidly drop. Because of this low pressure, the boiling point of the coolant contained in the system falls to a level at or below its current temperature. This causes vaporization and reduces the cooling system's overall effectiveness.

Figure 2:
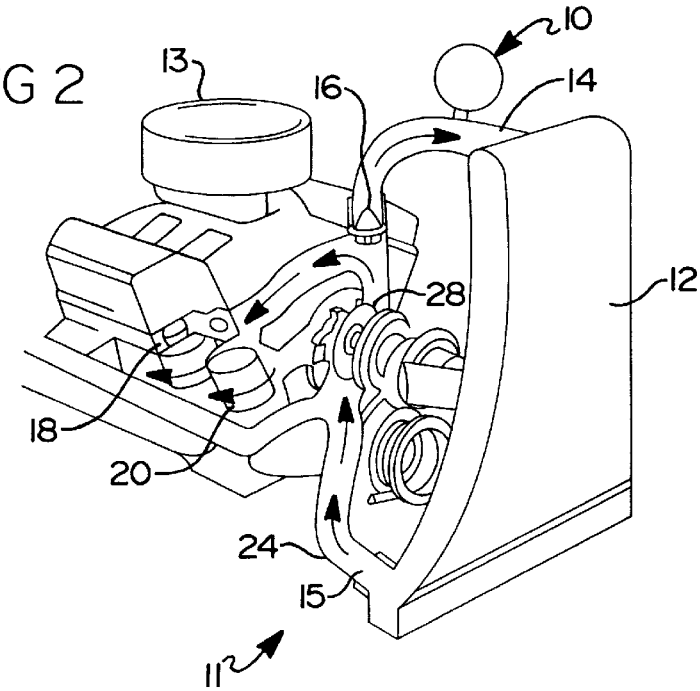
FIG. 2 is a perspective view of an internal combustion engine and a cooling circuit having a pressurized reservoir according to the present invention.

Referring now to FIG. 2, a pressurized reservoir 10 according to the present invention is shown in conjunction with an engine cooling system 11 and internal combustion engine 13. Engine cooling system 11 has a radiator 12 which is fluidly connected to internal combustion engine 13 by upper hose 14 and lower hose 24. This fluid connection allows lower hose 24 to circulate coolant 15 through a cylinder block water jacket 20 and cylinder head water jacket 18 of internal combustion engine 13. Water pump 28 facilitates this flow by drawing water from lower hose 24 and pushing it through cylinder block water jacket 20 and cylinder head water jacket 18. Within cylinder block water jacket 20 and cylinder head water jacket 18, heat is transferred to coolant 15 thereby cooling internal combustion engine 13 and heating coolant 15. Heated coolant 15 travels out of internal combustion engine 13 and travels into upper hose 14 if thermostat 16 is open. If thermostat 16 is closed, coolant 15 is recirculated through cylinder block water jacket 20 and cylinder head water jacket 18. Thermostat 16 opens at a predefined coolant temperature to allow coolant 15 to flow into upper hose 14 and into radiator 12. Radiator 12 uses airflow between fluid passages thereof to cool the heated coolant 15 and provide cool coolant 15 back to lower hose 24 for recirculation.

Figure 3:
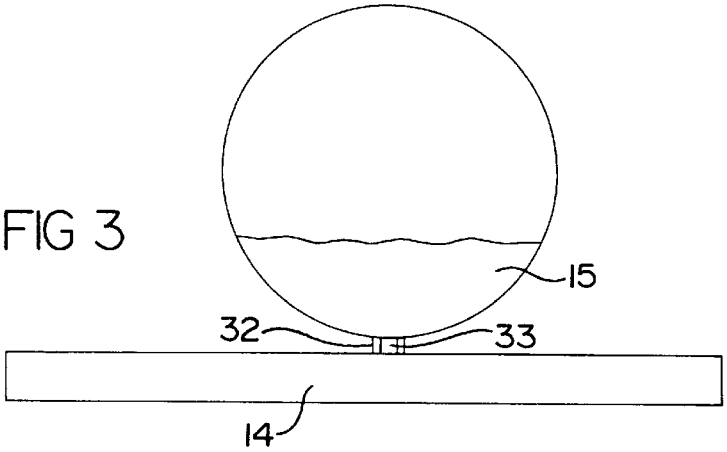
FIG. 3 is a cross-sectional view of a pressurized reservoir according to the present invention.

Referring now to FIGS. 2 and 3, pressurized reservoir 10 fluidly communicates with upper hose 14 to allow heated and pressurized coolant 15 to flow therein. Pressurized reservoir 10 generally comprises a spherical wall portion 17 which encapsulates an air filled center. Wall portion 17 is airtight and is preferably made of plastic or other suitable material which is able to withstand temperatures in the range of 130 degrees C. Contained within pressurized reservoir 10 is air. This air remains at ambient pressure when no coolant 15 has entered said reservoir. This allows the tank to be constructed from an inexpensive material since the tank does not have to be maintained at high pressure all the time. Pressurized reservoir 10 fluidly communicates with upper hose 14 by tube 32. Like wall portion 17, tube 32 is airtight and allows coolant 15 from upper hose 14 to flow within wall portion 17 of pressurized reservoir 10. Preferably, reservoir 10 is oriented such that it is above upper hose 14 such that the buoyancy of air and gravity tend to push coolant 15 back into upper hose 14. This helps ensure that air and coolant do not mix. Preferably, tube 32 has a meltable plug 33 which, when coolant 15 achieves a predetermined temperature, melts. This allows the cooling system to be filled with coolant 15 while maintaining pressurized reservoir 10 dry for assembly purposes. Once the temperature of cooling system 11 achieves the predetermined temperature, meltable plug 33 melts, thereby allowing uninterrupted communication between the coolant flow circuit and the reservoir for normal operation of the system.

When the internal combustion engine 13 is first started, internal combustion engine 13 and coolant within engine cooling system 11 are at ambient temperature. Also, thermostat 16 is closed. As internal combustion engine 13 is run, its temperature and the corresponding temperature of coolant 15 within cooling system 11 increases. This causes thermostat 16 to open, allowing coolant from internal combustion engine 13 to circulate through radiator 12 and dissipate heat.

When internal combustion engine 13 undergoes extreme loads, such as that associated with mountain driving or hauling, heat is transferred to cooling system 11 faster than radiator 12 can dissipate it. This results in an overall increase in temperature of coolant within engine cooling system 11. As is known, the increased temperature of the coolant 15 corresponds to an increased pressure in a closed system. Increased pressure results in an increased boiling point. An increased boiling point allows more heat to be transferred to coolant 15 before it boils. When the temperature of coolant within engine cooling system 11 reaches its boiling point temperature, coolant within engine cooling system 11 evaporates, creating a concentration of vapor within radiator 12 and engine 13. Because vapor has poorer heat transfer characteristics than liquid, the effectiveness of radiator 12 for dissipating head is reduced when coolant 15 boils. Therefore, it is desirable to maintain the pressure within cooling system as high as possible to maintain an elevated boiling point of coolant 15. However, the design characteristics of cooling system 11 allows coolant 15 to reach a finite pressure, typically 14–18 PSIG. Once coolant 15 exceeds this pressure, some coolant must be bled from the system, thereby expanding the volume and correspondingly dropping the pressure of coolant 15. As such, pressurized reservoir 10 of the present invention provides for this expansion.

As coolant 15 increases in pressure, it flows into pressurized reservoir 10 from upper hose 14. This expansion causes air within pressurized reservoir 10 to compress, thereby increasing its pressure and the pressure of the corresponding coolant 15. Since the air initially within pressurized reservoir 10 was at ambient pressure, the increase in pressure is greater than ambient pressure. This, in turn, maintains the pressure within engine cooling system 11 at higher than ambient pressure.

When internal combustion engine 13 undergoes a light load, such as when traveling on the down side of a mountain, it transfers heat to coolant 15 at a rate lower than that which radiator 12 can dissipate. As a result, the overall temperature of coolant 15 is reduced, thereby reducing the overall pressure within engine cooling system 11. Since the previous flow of coolant into pressurized reservoir 10 created increased pressure therein, there exists a pressure differential between pressurized reservoir 10 and cooling system 11. This pressure differential forces coolant 15 back into upper hose 14 and back into engine cooling system 11, thereby maintaining pressure within cooling system 11 at a level either as high as or higher than ambient pressure.

Figure 4:
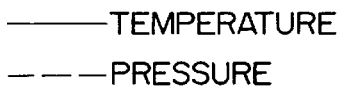
FIG. 4 is a graphical depiction of the state of the engine coolant during operation of a vehicle using a pressurized reservoir according to the present invention.

Referring now to FIG. 4, the operation of the present invention is graphically depicted. Between time=0 and time=10 minutes, a vehicle containing internal combustion engine 13 undergoes a heavy load, such as that associated with traveling up the side of a mountain. As depicted in FIG. 4, the temperature and corresponding pressure increases during this time frame due to this load. This causes coolant 15 to expand into pressurized reservoir 10, thereby increasing pressure therein and within engine cooling system 11. Between time=10 minutes and time=20 minutes, the vehicle containing internal combustion engine 13 undergoes a light load, such as that associated with traveling down the side of a mountain. During this time, the temperature of coolant 15 within engine cooling system 11 decreases (as discussed above), thereby allowing coolant within pressurized reservoir 10 to flow back into cooling system 11 and maintain the corresponding pressure above atmospheric pressure.

Figure 5:
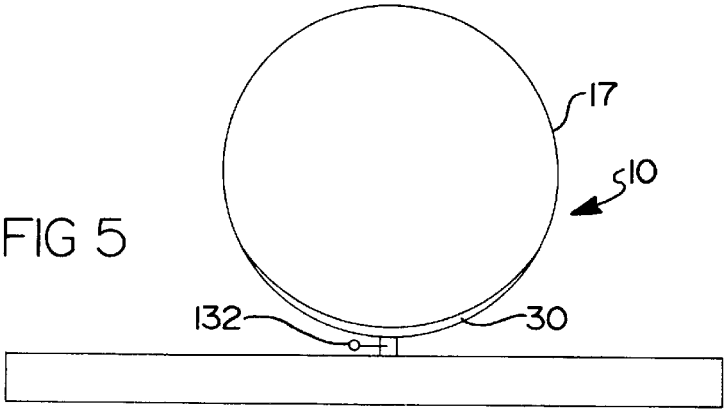
FIG. 5 is a cross-sectional view of a second embodiment of a pressurized reservoir according to the present invention.

Referring now to FIG. 5, a second embodiment of the present invention is described. In FIG. 5, pressurized reservoir 10 is shown having membrane 30 disposed therein which ensures that air within pressurized reservoir 10 and coolant 15 flowing therein are separated. Pressurized reservoir 10 is also fitted with a valve cock 132 which, when opened, allows coolant 15 to flow into pressurized reservoir 10. Like meltable plug 33, valve cock 132 allows the cooling system to be filled while maintaining the reservoir in a dry state.

While the above detailed description describes the preferred embodiment of the invention, it should be understood that the present invention is susceptible to modification, variation, and alteration without deviating from the scope and fair meaning of the following claims.

What is claimed is:

1. A reservoir for a cooling system for an internal combustion engine, said reservoir comprising:

a receptacle for receiving coolant, said receptacle being substantially airtight, said receptacle having an external passageway for conducting coolant into and out of said receptacle, said external passageway attachable to a portion of said cooling system to allow airtight transfer of coolant into and out of said receptacle; and a melt plug located in said external passageway, said melt plug preventing said transfer of coolant into and out of said reservoir.

2. A reservoir as claimed in claim 1, wherein said melt plug liquefies at a predetermined temperature.

3. A reservoir as claimed in claim 2, wherein said melt plug liquefies at a temperature above 70 degrees C.

4. A reservoir for a cooling system for an internal combustion engine, said reservoir comprising:

a receptacle for receiving coolant, said receptacle being substantially airtight, said receptacle having an external passageway for conducting coolant into and out of said receptacle, said external passageway attachable to a portion of said cooling system to allow airtight transfer of coolant into and out of said receptacle; and a manually operated valve located in said external passageway, said manually operated valve selectively actuable to allow and disallow said transfer of coolant into and out of said reservoir.

* * * * *